US005598992A

United States Patent [19]

Chew

[11] Patent Number: 5,598,992

[45] Date of Patent: Feb. 4, 1997

[54] RAILWAY SWITCH CIRCUIT CONTROLLER

[75] Inventor: James P. Chew, Westmoreland County, Pa.

[73] Assignee: Union Switch & Signal Inc., Pittsburgh, Pa.

[21] Appl. No.: 507,549

[22] Filed: Jul. 26, 1995

[51] Int. Cl.[6] ..... B61L 5/00

[52] U.S. Cl. ..... 246/253

[58] Field of Search ..... 246/253, 220, 246/219, 415 R, 401, 246, 221, 218

[56] References Cited

U.S. PATENT DOCUMENTS

| | | | |
|---|---|---|---|
| 1,333,501 | 3/1920 | McCarthy | 246/253 |
| 1,667,473 | 4/1928 | Howe | 246/253 |
| 2,053,891 | 9/1936 | Beall | 246/253 |
| 2,747,056 | 5/1956 | Jefferson | 246/253 |
| 3,038,991 | 6/1962 | Swanton | 246/253 |

OTHER PUBLICATIONS

Union Switch & Signal Price List Catalog: Effective Jan. 1, 1991, p. 114.

"Railway Signal Equipment" published by Union Switch & Signal Section on U–5 Switch Circuit Controller, Jun. 1986.

*Primary Examiner*—Mark T. Le

*Attorney, Agent, or Firm*—Buchanan Ingersoll, P.C.; Robert J. Pugh

[57] ABSTRACT

A railway switch circuit controller having a housing with a bottom surface and opposed side surfaces. The bottom surface has a raised planar boss provided thereon, in which the raised boss is cast upon the bottom surface and is then machined so as to have a flat surface and a selected height. The side surfaces have respective openings provided therethrough for receiving a shaft. The shaft is rotatably disposed through the side surface openings and has one or more cam segments disposed thereupon. Each cam is engageable with a follower in which the follower is biased to a first position but rotation of the shaft causes the cam to move the follower to a second position. The follower is connected to a movable contact of a contact spring assembly. The contact spring assembly also has one or more sets of first and second generally nonmovable contacts in which the movable contact is disposed between the two nonmovable contacts. The contact spring assembly is secured to a terminal board. The terminal board has a planar portion that is matable and is secured to the raised boss of the controller housing bottom surface.

5 Claims, 3 Drawing Sheets

RAILWAY SWITCH CIRCUIT CONTROLLER

BACKGROUND OF THE INVENTION

1. Field of the Invention

The invention relates generally to switch points for railroad tracks and, more particularly, to means for positively determining the position of such switch points.

2. Description of the Prior Art

Railway turnouts alternatively divert trains from one track to other tracks. A common turnout used in the industry has a switch property which includes switch points, a switch machine and an operating rod to initiate diversion of the wheels, a frog to carry the train wheel flanges across opposing rails and lead rails between the frog and the switch. The switch points are typically moved by means of the operating rod which is attached to the switch point and is also connected to the switch machine. In operation, the operating rod is translated by the switch machine causing the switch points to move.

A switch circuit controller is a device that is mounted to the railroad ties and is connected to the operating rod. The switch circuit controller provides a signal indicating the position of the switch point. The signal produced by the switch circuit controller is a vital indication which means that the signal need not be checked further and may be presumed to be accurate. A typical switch circuit controller of the prior art is the U-5 switch circuit controller manufactured by Union Switch & Signal Inc. which is shown in prior art FIGS. 1 and 2.

As an alternative to a single operating rod that is connected to the switch circuit controller, one or more switch rods that are separate from the operating rod may be connected to the switch point, and the switch circuit controller may then be connected to this switch rod. As the switch point moves back and forth, the switch rod which is connected to the switch point will also move back and forth.

Whether the switch circuit controller is connected to the operating rod or to a switch rod, movement of the rod will cause a crank arm (depicted as "a" in prior art FIGS. 1 and 2) of the switch circuit controller to rotate. The switch circuit controller typically has a cast iron housing (depicted as "b" in prior art FIGS. 1 and 2) having circular openings through opposed side walls. The crank arm is located outside of the controller housing and is connected to a cam shaft. The cam shaft (depicted as "c") is rotatable, having one or more cam segments (depicted as "d") provided thereon. The cams are sized, configured and positioned so as to be engageable with one or more movable followers (depicted as "e"). The followers are spring-biased toward a given position. The followers further are connected to respective movable electrical heel contacts (depicted as "f").

The switch circuit controller also has a contact spring assembly that is comprised of two spaced-apart fixed electrical contacts (called front and back contact springs and depicted as "g" and "h", respectively) and the movable heel contact. The heel contact spring is positioned between the front contact spring and the back contact spring and may alternatively make contact with either the front or back contact spring. Silver pads are provided on the heel contacts and silver tips are provided on the distal ends of the front and back contacts to increase conductivity through the contacts.

The contact spring assembly is mounted within the switch circuit controller by being secured to a terminal board (depicted as "i"). The terminal board is in turn mounted within the switch circuit controller housing. The housing b is equipped with integrally cast vertical ribs j. Terminal board i abuts the as-cast surfaces of ribs j and is retained by them by brackets k and bolts l. The terminal board is made of an insulative material. Thus, the terminal board performs the function of supporting the contact spring assembly and also performs the function of insulating the contact springs from one another and the metal housing.

When the operating rod is thrown by the switch machine to move the switch point, the translation of the operating rod causes the crank arm to rotate. When the crank arm rotates, the cam shaft rotates within the switch circuit housing. The cams attached to the cam shaft then engage the followers. The followers are normally spring-biased so that the movable contacts to which they are connected are biased into contact with the back contact springs. When the cams engage the followers, the movable contact springs are forced forward into contact with the front contact springs. Contact of the movable contact springs with either the front contact springs or the back contact springs causes different circuits to be completed, which in turn causes respective signals to be produced. Thus, movement of the switch point causes electrical contacts to be made inside the case of the controller.

The terminal board of the prior art is typically made of a thermoset phenolic plastic such as Bakelite manufactured by Union Carbide Corp. Two ribs are then cast integral with the housing of the switch circuit controller. The terminal board is drawn up against the ribs and tightened down thereto by means of a bracket or a number of brackets, and mounting bolts. The brackets are mounted to the terminal board and are so configured that tightening a threaded fastener upon them will force the terminal board onto the ribs. The mounting bolts pass through aligned holes in the terminal board and the ribs.

The lost motion between the cams of the cam shaft, the crank arm and the operating rod often must be adjusted. Further, adjustments must be made between the movable contact springs and the front and back contact springs. Such adjustments are often difficult because the as-cast housing of the switch circuit controller may have slight deviations in the ribs. Furthermore, the locations of the front and back contact springs, relative to the can shaft, depends upon the location of the ribs relative to the openings in the controller housing through which the cam shaft is disposed. If the ribs are not cast the correct distance from the location of the openings in the housing for the cam shaft, difficulty is encountered when an attempt is made to adjust the contact springs. Also, excessive roughness of the sand cast surfaces of the ribs will not allow the terminal board to sit securely. Because of the location and configuration of the ribs, machining the ribs to provide a smooth mounting surface for the terminal board is difficult.

Therefore, a switch circuit controller that has means for positively locating the terminal board is needed. Such means should simplify the manner in which the terminal board is mounted to the controller housing, while providing adequate support of the contact spring assembly.

SUMMARY OF THE INVENTION

An improved railway switch circuit controller is provided in which a terminal board is modified so as to eliminate the need for brackets used in the prior art to secure the terminal board to the switch circuit controller housing. The switch circuit controller has a controller housing. The controller housing has a bottom surface and opposed side surfaces. The controller housing bottom surface is provided with a raised planar boss. The raised boss is cast upon the bottom surface of the controller housing and is machined so as to have a flat surface and a selected height.

The opposed side surfaces of the switch circuit controller preferably have respective openings provided therethrough. A shaft is then disposed through the opposed openings in the side surfaces so that the shaft may rotate through the openings. The shaft also has either a number of cam segments or a single elongated cam segment disposed upon it.

The cams cooperate with one or more followers that are preferably rotatably connected to the controller housing such as by a pivot pin. The followers are capable of moving through at least two positions and are each biased to a first position (preferably, toward the rear of the controller housing) through such biasing means as a spring.

The followers may be moved by the cam segments to a second position (preferably, toward the front of the controller housing) when the cam shaft is rotated a selected amount in a selected direction. When the cam shaft is rotated in an opposite direction, the cam segments no longer urge the followers toward a second position and the spring biases the followers toward the first position.

The switch circuit controller also has a contact spring assembly which allows the controller to alternatingly complete two different electrical circuits, with each circuit being connected to a respective signalling means. The contact spring assembly has a number of sets of first and second generally nonmovable electrical contacts. The contact spring assembly also has one or more movable contacts, with each movable contact being disposed between a respective front and rear contacts. The followers each have movable contacts connected at a distal end of the follower. Thus, each movable contact is biased toward contact with a respective rear contact but is movable into contact with a respective front contact when the follower to which it is connected is urged toward the front of the controller housing by the cams.

The contact spring assembly is secured to a terminal board, which is, in turn, secured to the controller housing. The terminal board has a flat mounting portion that mates with and is secured to the flat surface of the raised boss of the controller housing. The terminal board is preferably L-shaped and made of a sufficiently strong and electrically insulative material, such as fiberglass-reinforced polyester. The one-piece terminal board may then be secured directly to the machined surface of the raised boss of the switch circuit controller housing, eliminating the need for ribs that had previously been cast into the surface of the switch circuit controller housing to help position the terminal board.

The machining of the boss may be performed using any precisely controlled machining technology such as numerically controlled machining technology. Thus, the distance from the center line of the cam segment shaft to the terminal board may be precisely controlled.

Other objects and advantages of the invention will become apparent from a description of certain present preferred embodiments thereof shown in the drawings.

DETAILED DESCRIPTION OF THE PREFERRED EMBODIMENTS

Figure 2:
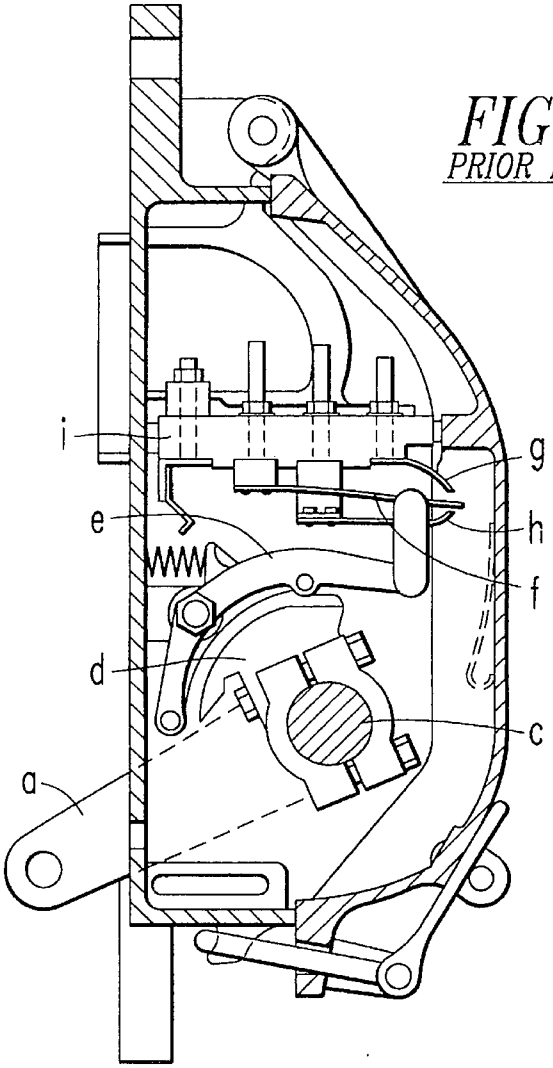
FIG. 2 PRIOR ART
FIG. 2 is a side view taken in cross section of the prior art switch circuit controller of FIG. 1.
Figure 1:
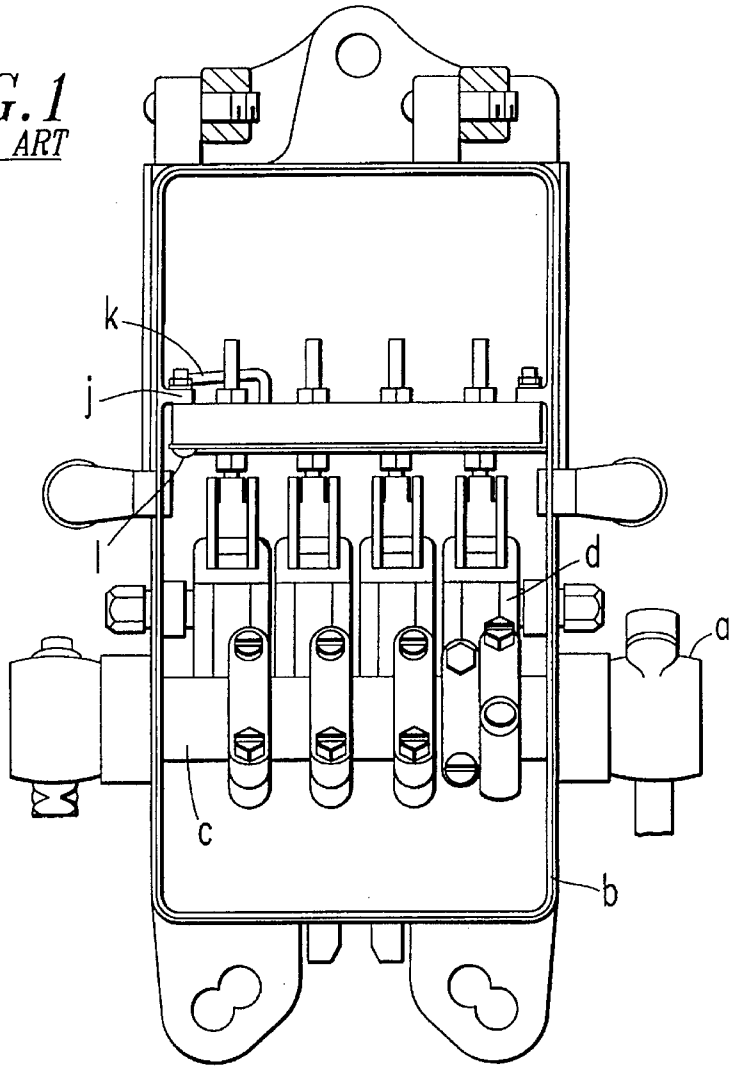
FIG. 1 PRIOR ART
FIG. 1 is a top plan view taken in cross section of a switch circuit controller of the prior art.
Figure 4:
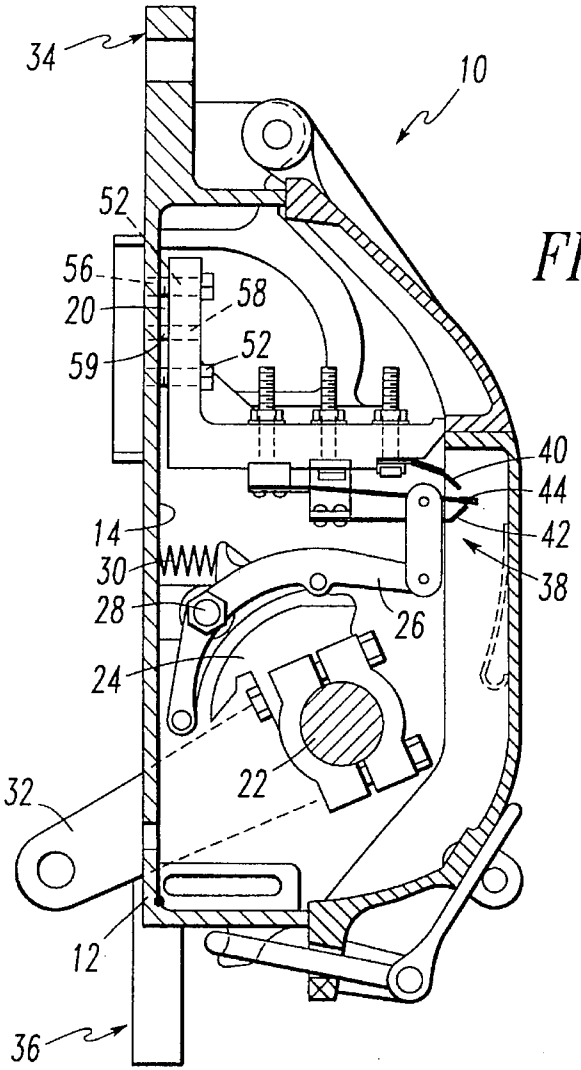
FIG. 4 is a side view taken in cross section of the presently preferred switch circuit controller of FIG. 3.
Figure 3:
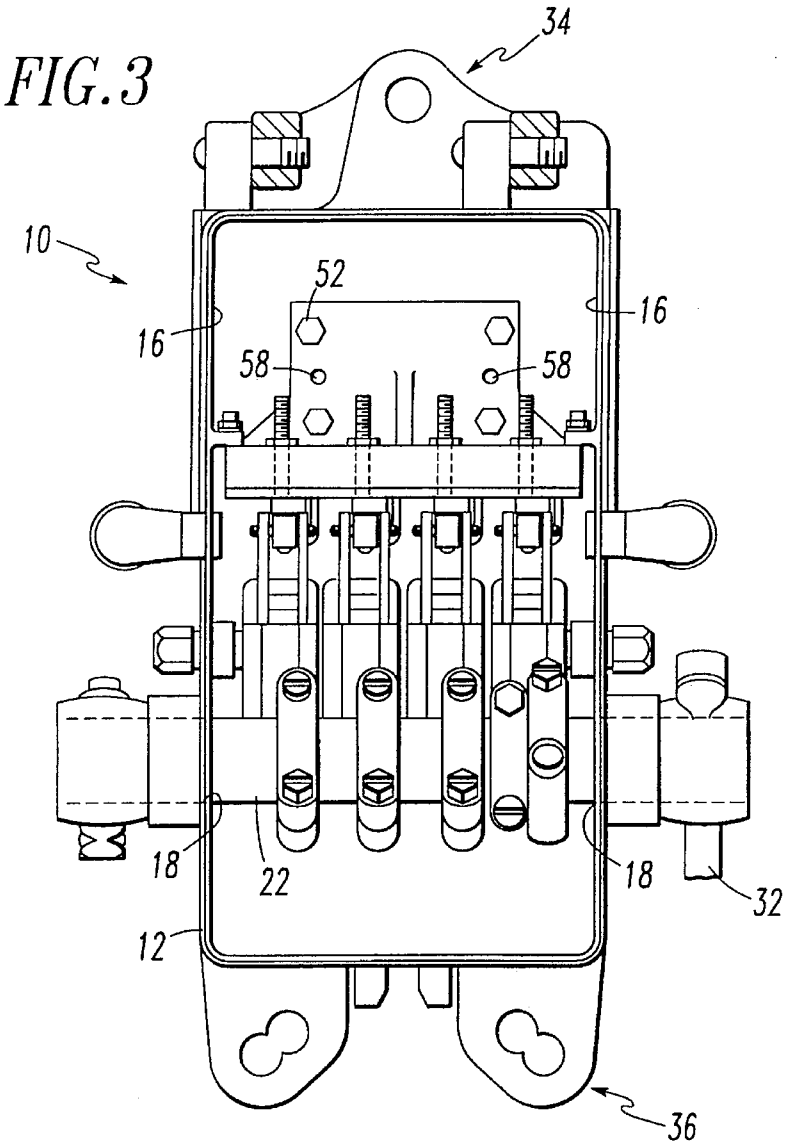
FIG. 3 is a top plan view taken in cross section of the presently preferred switch circuit controller.

The improved railway switch circuit controller 10 of the present application is shown in FIGS. 3 and 4. The switch circuit controller 10 has a controller housing 12 that has a bottom surface 14 and opposed side surfaces 16. A pair of opposed side surfaces 16 have respective openings 18 provided therethrough.

The controller housing bottom surface 14 has a raised planar boss 20 provided thereon. The raised boss 20 is cast upon the bottom surface 14 of the controller housing 12 and is then machined so as to have a flat surface and a selected height.

A shaft 22 is disposed through the opposed openings 18 in the side surfaces 16. The shaft 22 and the openings are sized and configured so that the shaft 22 may rotate through the openings 18. The shaft 22 also has at least one cam segment 24 disposed upon it. Either a number of cam segments 24 or a single elongated cam segment 24 may be used.

One or more followers 26 are movably connected to the controller housing 12. Preferably, the followers 26 are rotatably mounted to a pivot pin 28, however, any means for movably connecting the followers 26 to the controller housing 12 may be used. The followers 26 are capable of moving through at least two positions and are each biased to a first position. The first position is preferably toward the rear of the controller housing and is indicated generally as 36 in FIG. 4. The preferred means of biasing the followers 26 is through the use of one or more springs 30, however, any suitable biasing means may be used.

The followers 26 are engageable by the cam segments 24 when the cam shaft 22 is rotated a selected amount in a selected direction. When the cam segments 24 engage the followers 26, the followers 26 are urged forward to a second position. The second position is preferably toward the front of the controller housing which is indicated generally as 34 in FIG. 4.

Thus, the cam segments 24 and the followers 26 are preferably sized, configured and positioned so that the cam segments 24 are normally positioned toward the rear 36 of the controller housing 12. When the shaft 22 is caused to rotate approximately a quarter turn by the operating rod (not shown in the figures), the crank arm 32 is pivoted and the cam segments then engage the followers urging the followers to a position toward the front 34 of the controller housing 12.

Figure 5:
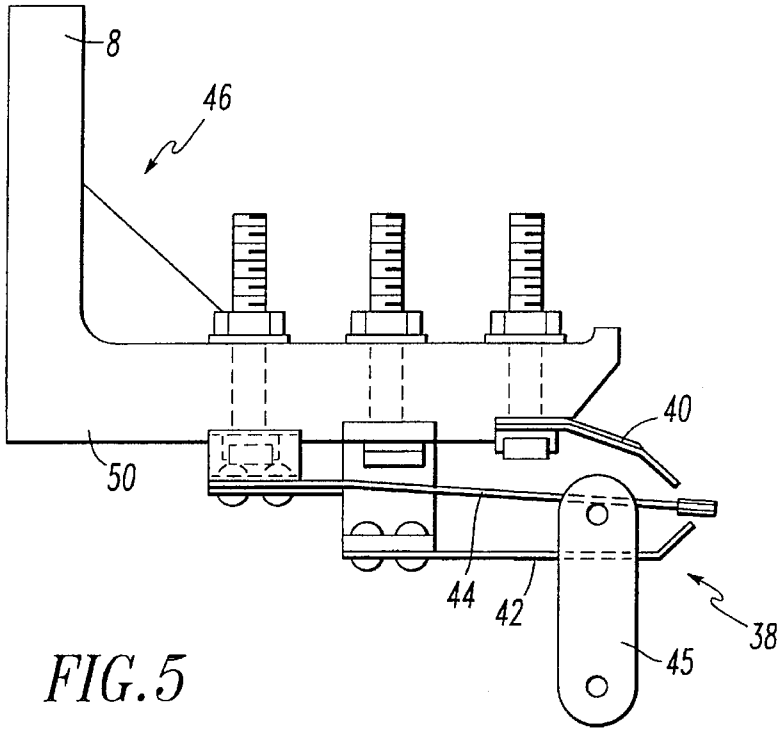
FIG. 5 is a side elevational view of the preferred terminal board and associated components of the switch circuit controller.

The switch circuit controller 10 also has a contact spring assembly 38 which is shown best in FIG. 5. The contact spring assembly 38 performs the crucial function of allowing the controller 10 to alternatingly complete two different electrical circuits, with each circuit being connected to a respective signalling means (not shown in the figures). To do this, the contact spring assembly 38 has one or more sets of front and rear generally nonmovable electrical contacts 40, 42, respectively. The contact spring assembly 38 also has one or more movable contacts 44, in which each such movable contact 44 is disposed between a respective set of front and rear contacts 40, 42.

Figure 6:
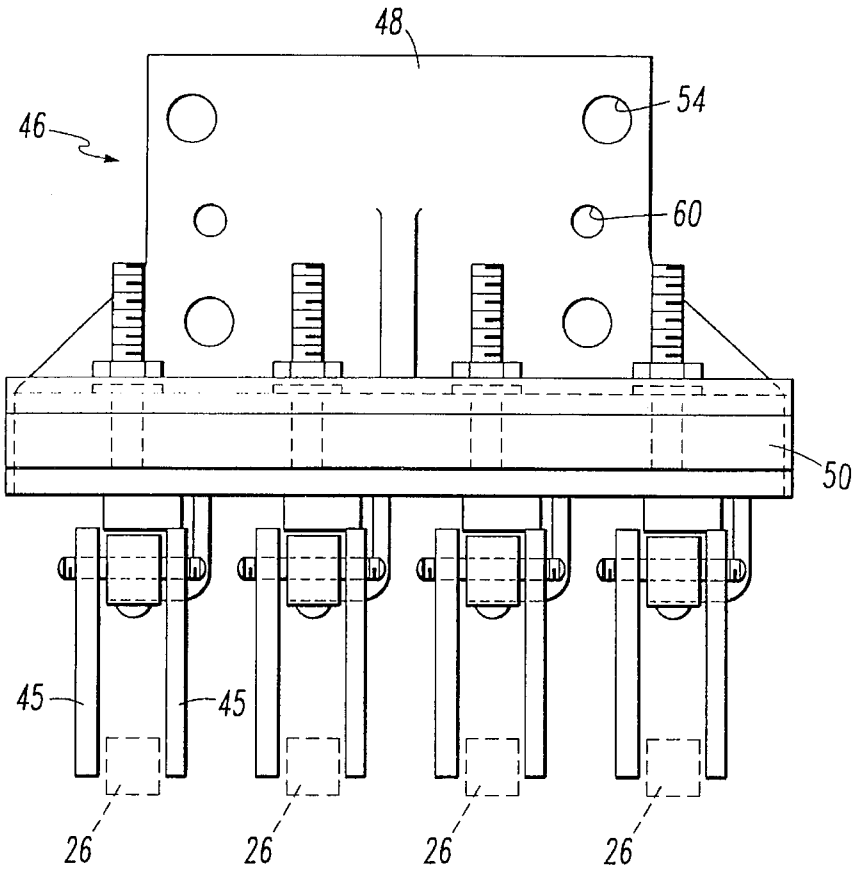
FIG. 6 is a top plan view of the preferred terminal board and associated components of the switch circuit controller.

Each movable contact 44 is connected to a follower 26 (shown in FIG. 4 and shown in dotted line in FIG. 6). Each movable contact 44 is preferably connected to a follower 26 through a pair of linkages 45. With the movable contacts 44 and followers 26 thus connected, each movable contact 44 is placed into contact with a respective rear nonmovable contact 42 when the follower 26 to which it is connected is biased toward the rear 36 of the switch circuit controller 10 and the cams 24 are not engaging that follower 26. Each moveable contact 44 is then placed into contact with a respective front nonmovable contact 40 when the follower 26 to which it is connected is urged toward the front 34 of the controller housing 12 by the cams 24.

A terminal board 46, shown in FIGS. 3 and 4 and shown particularly in FIGS. 5 and 6, is then secured to the controller housing 12. The contact spring assembly 38 is secured to the terminal board 46 preferably by each contact spring being bolted to the terminal board 46. It is understood, however, that any suitable means for securing the contact springs to the terminal board may be utilized. The terminal board 46 has a planar mounting portion 48 that is matable and is secured to the raised boss 20 of the controller housing bottom surface 14. The terminal board 46 is made of an electrically insulative material. A sufficiently strong insulating material is preferably used for the terminal board 46 of the presently described switch circuit controller 10, otherwise the terminal board 46 could develop fatigue cracks and eventually break. Preferably, the terminal board 46 is made of fiberglass-reinforced polyester. The terminal board 46 is preferably L-shaped so as to have an elongated, contact spring mounting portion 50 extending outward generally perpendicularly from the planar mounting portion 48. The contact spring assembly 38 is preferably secured to the contact spring mounting portion 50 of the terminal board 46.

Through the use of the presently described terminal board 46 and the boss mounting surface 20 of the controller housing, ribs that had previously been cast into the surface of the switch circuit controller housing 12 to help position the terminal board 46 may be removed. Instead, the raised boss 20 is cast onto the bottom surface 14 of the switch circuit controller housing 12 and is machined so as to have a smooth, flat surface. The one-piece, L-shaped terminal board 46 may then be secured directly to the machined surface of the raised boss 20 of the switch circuit controller housing 12.

The machining of the boss surface 20 of the switch circuit controller housing 12 may be performed using numerically controlled machining technology or other precisely controlled machining technology. In this way, the distance from the cam segment shaft 22 to the terminal board 46 may be precisely controlled. Thus, the presently described improvement to the switch circuit controller 10 serves to positively locate the terminal board 46 relative to the controller cam segment shaft 22.

The terminal board 46 is preferably fastened to the machined surface of the boss 20 by four bolts 52. The bolts 52 pass through holes 54 in terminal board 46, and thread into tapped holes 56 in the boss 20. Two dowel pins 58 are pressed into holes 59 in the boss 20, the holes 59 in boss 20 sized such that pins 58 are tightly retained therein. These pins 58 engage holes 60 in the terminal board 46 and positively and accurately locate the terminal board 46 at the desired distance from the cam segment shaft 22. Holes 60 are sized and spaced such that the terminal board 46 may be easily placed over pins 58 so that planar mounting portion 48 abuts boss 20 of housing 12; and the board 46 may not be moved appreciably in the plane perpendicular to the axis of pins 58.

When the pins 58 and holes 60 are aligned, bolt holes 54 and 56 in board and housing are also aligned.

With the exception of the configuration of the terminal board 46 and the manner in which the terminal board 46 is mounted to the switch circuit controller housing 12, the switch circuit controller 10 operates in a substantially identical manner as the previous switch circuit controller 10. Thus, parts used with the previous switch circuit controller 10 may be interchangeably used with the present invention.

The advantage of the presently described method of terminal board mounting is that no adjustment of the terminal board is needed after it has been mounted. The dowel pins fix the terminal board location permanently.

While certain present preferred embodiments have been shown and described, it is distinctly understood that the invention is not limited thereto but may be otherwise embodied within the scope of the following claims.

I claim:

1. A railway switch circuit controllers, comprising:

a controller housing having a bottom surface and opposed side surfaces, wherein said side surfaces have respective openings provided therethrough, and wherein said bottom surface has a raised planar boss provided thereon, in which said raised boss is cast upon said bottom surface and is then machined so as to have a flat surface and a selected height;

a shaft rotatably disposed through said side surface openings, wherein said shaft has a plurality of cam segments disposed thereupon;

a plurality of followers that are each movably connected to said controller housing, wherein said plurality of followers are biased through a biasing means to a first position, and wherein selected followers are engageable with selected cam segments when said shaft is rotated a selected amount so as to urge said followers to a second position;

a contact spring assembly that has a set of first and second generally nonmovable electrical contacts and a set of movable contacts disposed therebetween, wherein each of said movable contacts are connected to a respective follower such that each of said movable contacts are moved into contact with a respective first nonmovable contact when said followers are biased into said first position and are each moveable into contact with a respective second nonmovable contact when said followers are urged into said second position;

a terminal board having said contact spring assembly secured thereto, said terminal board has a planar mounting portion that is matable and is securable to said raised boss of said controller housing bottom surface;

wherein said terminal board further has an elongated contact spring mounting portion that extends outward from said planar mounting portion;

wherein said contact spring mounting portion of said terminal board is planar;

wherein said contact spring mounting portion of said terminal board extends outward generally perpendicular from said planar mounting portion; and wherein said terminal board is generally L-shaped when viewed in cross section.

2. The switch circuit controller of claim 1 wherein said terminal board is made of an insulative material.

3. The switch circuit controller of claim 2 wherein said terminal board is made of fiberglass-reinforced polyester.

4. A railway switch circuit controller, comprising:

a controller housing having a bottom surface and opposed side surfaces, wherein said side surfaces have respective openings provided therethrough, and wherein said bottom surface has a raised planar boss provided thereon, in which said raised boss is cast upon said bottom surface and is then machined so as to have a flat surface and a selected height;

a shaft rotatably disposed through said side surface openings, wherein said shaft has a plurality of cam segments disposed thereupon;

a plurality of followers that are each movably connected to said controller housing, wherein said plurality of followers are biased through a biasing means to a first position, and wherein selected followers are engageable with selected cam segments when said shaft is rotated a selected amount so as to urge said followers to a second position;

a contact spring assembly that has a set of first and second generally nonmovable electrical contacts and a set of movable contacts disposed therebetween, wherein each of said movable contacts are connected to a respective follower such that each of said movable contacts are moved into contact with a respective first nonmovable contact when said followers are biased into said first position and are each moveable into contact with a respective second nonmovable contact when said followers are urged into said second position;

a terminal board having said contact spring assembly secured thereto, said terminal board has a planar mounting portion that is matable and is securable to said raised boss of said controller housing bottom surface;

wherein said terminal board is generally L-shaped so as to have a contact spring mounting portion to which said contact spring assembly is secured and wherein said planar mounting portion extends outward from said contact spring mounting portion.

5. A railway switch circuit controller, comprising:

a controller housing having a bottom surface and opposed side surfaces, wherein said bottom surface has a raised planar boss provided thereon, in which said raised boss is fixed upon said bottom surface and has a flat surface and a selected height;

a terminal board having a contact spring assembly secured thereto, said terminal board has a planar mounting portion that is matable and securable to said raised boss of said controller housing bottom surface; and wherein said terminal board is generally L-shaped so as to have a contact spring mounting portion to which said contact spring assembly is secured and wherein said planar mounting portion extends outward from said contact spring mounting portion.

* * * * *